US008567013B2

(12) United States Patent
Yamaoka et al.

(10) Patent No.: US 8,567,013 B2
(45) Date of Patent: Oct. 29, 2013

(54) DOOR BODY HOLDING STRUCTURE

(75) Inventors: Kiyoshi Yamaoka, Toyoake (JP); Takashi Hibino, Toyoake (JP); Nobuo Kondo, Toyoake (JP); Hideo Ishigure, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 258 days.

(21) Appl. No.: 13/124,610

(22) PCT Filed: Nov. 6, 2009

(86) PCT No.: PCT/JP2009/068998

§ 371 (c)(1),
(2), (4) Date: Apr. 15, 2011

(87) PCT Pub. No.: WO2010/092715

PCT Pub. Date: Aug. 19, 2010

(65) Prior Publication Data

US 2011/0197392 A1 Aug. 18, 2011

(30) Foreign Application Priority Data

Feb. 16, 2009 (JP) ..... 2009-032998

(51) Int. Cl.
*E05C 17/64* (2006.01)

(52) U.S. Cl.
USPC ..... 16/342; 16/319; 16/356; 16/374

(58) Field of Classification Search
USPC ..... 16/82, 224, 319, 321, 342, 355, 356, 16/360, 363, 374, 377
See application file for complete search history.

(56) References Cited

U.S. PATENT DOCUMENTS 2,120,684 A * 6/1938 Soss ..... 16/356
2,302,661 A * 11/1942 Benson ..... 16/267
2,342,477 A * 2/1944 Magnenat ..... 220/835
2,732,581 A * 1/1956 Heck ..... 220/840

(Continued)

FOREIGN PATENT DOCUMENTS

JP S59-8527 A 1/1984
JP H04-185881 A 7/1992

(Continued)

*Primary Examiner* — Roberta DeLisle
(74) *Attorney, Agent, or Firm* — DLA Piper LLP (US)

(57) ABSTRACT

A door body holding structure that can hold a door body at an open position by using a simple configuration. A projecting portion 40, which projects toward a containing wall 38 side, is provided on an outer surface of a bearing portion 32 of a fixed-side hinge at a position facing the containing wall 38 where the projecting portion 40 does not come into contact with an inner surface of a guide portion 34 when the door body 18 is at a closed position but the projecting portion 40 comes into contact with the inner surface of the guide portion 34 when the door body 18 is at the open position. A separation dimension between a projecting end of the projecting portion 40 and the containing wall 38 is set to be smaller than a thickness dimension of the guide portion 34. That is, when the inner surface of the guide portion 34 reaches the position at which it comes into contact with the projecting portion 40 by pivoting movement of the door body 18 from the closed position toward the open position, the guide portion 34 is sandwiched and held between the projecting portion 40 and the containing wall 38, thereby holding the door body 18 at the open position.

1 Claim, 5 Drawing Sheets

(56) References Cited

U.S. PATENT DOCUMENTS

| | | | | | |
|---|---|---|---|---|---|
| 2,772,916 | A | * | 12/1956 | Jones | 296/97.12 |
| 2,852,802 | A | * | 9/1958 | Seby | 16/356 |
| 3,359,594 | A | * | 12/1967 | Pastoor | 16/356 |
| 3,388,421 | A | * | 6/1968 | Koziol | 16/260 |
| 3,423,787 | A | * | 1/1969 | Horstman | 16/356 |
| 4,694,533 | A | * | 9/1987 | Doyen | 16/257 |
| 4,942,271 | A | * | 7/1990 | Corsi et al. | 174/101 |
| 5,075,927 | A | * | 12/1991 | Porta | 16/273 |
| 5,809,617 | A | * | 9/1998 | Harris et al. | 16/273 |
| 6,691,370 | B2 | * | 2/2004 | Tatara | 16/355 |
| 7,089,628 | B2 | * | 8/2006 | Lin et al. | 16/342 |
| 2003/0200628 | A1 | * | 10/2003 | Tatara | 16/355 |

FOREIGN PATENT DOCUMENTS

| | | | |
|---|---|---|---|
| JP | 3008304 | B | 3/1995 |
| JP | H08-116185 | A | 5/1996 |
| JP | H10-25947 | A | 1/1998 |
| JP | 2007-278384 | A | 10/2007 |

* cited by examiner

DOOR BODY HOLDING STRUCTURE

TECHNICAL FIELD

The present invention relates to a holding structure for a door body that is arranged on a housing in an openable/closable manner.

BACKGROUND ART

An automatic icemaker that continuously produces ice pieces, each haying a required shape is preferably utilized in facilities in, e.g., a café or a restaurant or any other kitchens. As shown in FIG. 8, in the automatic icemaker, a housing 10 having a heat-insulated structure formed into a required shape includes an ice storage house 14 having an ice storage room 12 storing a required quantity of ice pieces defined therein. A cabinet 16 accommodating an ice making mechanism (not shown) that produces ice pieces is arranged at a rear portion of an upper surface of the ice storage house 14, and the ice pieces produced by the ice making mechanism are sequentially ejected into the ice storage room 12 to be stored.

An ice discharge opening 10*a* for ice discharge, which is opened in an obliquely upward direction toward a front side, is opened at a position of the ice storage house 14 facing the front side of the cabinet 16. Further, a door body 18 that can open and close the ice discharge opening 10*a* is arranged on the housing 10 through a hinge device 20 at an upper end edge portion of the door body 18 so as to allow pivoting movement of the door body 18, and the door body 18 is configured to pivot between a closed position (a position indicated by a solid line in FIG. 8) at which the ice discharge opening 10*a* is closed and an open position (a position indicated by an alternate long and two short dashes line in FIG. 8) at which the ice discharge opening 10*a* is opened when a front end side is lifted up with the hinge device 20 functioning as a supporting point.

The door body 18 is held while being rested against a front surface of the cabinet 16 at the open position. That is, since the door body 18 is simply placed at the open position in such a manner that its gravity center is closer to the cabinet side apart from the supporting point of the hinge device 20, the door body 18 may be possibly pivoted to the closed position when the door body 18 moves away from the cabinet 16 due to vibration and others involved by an operation of the ice making mechanism. Therefore, an operator takes out the ice pieces with one hand while holding the door body 18 at the open position with the other hand, whereby an operation of taking out the ice pieces is complicated.

As a configuration that holds at the open position the door body that is arranged on the main body through the hinge device in the openable/closable manner, for example, Patent Document 1 disclose a configuration that an elastic member having a gear-like shape is arranged on a door body side, a bearing portion that meshes with the elastic member is arranged on a main body side, and the elastic member elastically meshes with the bearing portion at a position the door body is pivoted to, thereby holding the door body at the open position.

PRIOR ART DOCUMENTS

Patent Document

Patent Document 1: Japanese Patent Application Publication No. Hei 8-116185

DISCLOSURE OF INVENTION

Problem to be Solved by the Invention

In the hinge device, disclosed in Patent Document 1, the door body can be held at an arbitrary angle position with the elastic member of the door, body meshing with the bearing portion of the main body. That is, the elastic member requires elastic force that maintains a mesh state with respect to the bearing portion without being elastically deformed due to a weight of the door body. In other words, since the elastic force of the elastic member proportionately rises as the weight of the door body increases, a burden when forcibly elastically deforming the elastic member to pivot the door body increases. Therefore, it is very much a situation in which the hinge device disclosed in Patent Document 1 cannot be adopted for the door body whose weight increase due to, the heat-insulated stricture like the door body arranged in the automatic icemaker. Furthermore, drawbacks of the hinge device disclosed in Patent Document 1, i.e., a complicated configuration and a high cost are also pointed out.

In view of the problems inherent in the conventional technology, it is an object of the present invention to preferably solve these problems and provide a door body holding structure that can hold a door body at an open position by using a simple configuration.

Means for Solving Problem

To solve the problems and achieve the expected object, there is provided a door body holding structure according to claim 1 of the present invention, which is a door body holding structure that is pivotally supported at an upper end portion of a housing to be pivotable in a vertical direction and configured to be pivoted between a closed position at which an opening portion formed in the housing is. Closed and an open position at which the opening portion is opened based on upward pivoting movement from the closed position, the door body holding structure comprising:

a fixed-side hinge that is arranged on the housing;

a movable-side hinge that is arranged at an upper end portion of the door body and pivotally supported on the fixed-side hinge in a pivotable manner;

a sandwiched portion that is provided to the door body and configured to move on an outer side of the fixed-side hinge with the pivoting movement of the door body;

a holding portion that is provided to the housing to define between, the fixed-side hinge and itself a containing space configured to accommodate the sandwiched portion; and a sandwiching portion that is placed in the containing space and reduces a facing gap between the fixed-side hinge and the holding portion in the containing space to be smaller than a thickness dimension of the sandwiched portion, wherein the sandwiching portion is provided at, a position where the sandwiched portion is sandwiched and held between the sandwiching portion and the fixed side hinge or the holding portion when the door body is at the open position.

Effect of the Invention

According to the door body holding structure of the present invention, the door body can be held at the open position by using the simple configuration.

BEST MODE(S) FOR CARRYING OUT THE INVENTION

Figure 8:
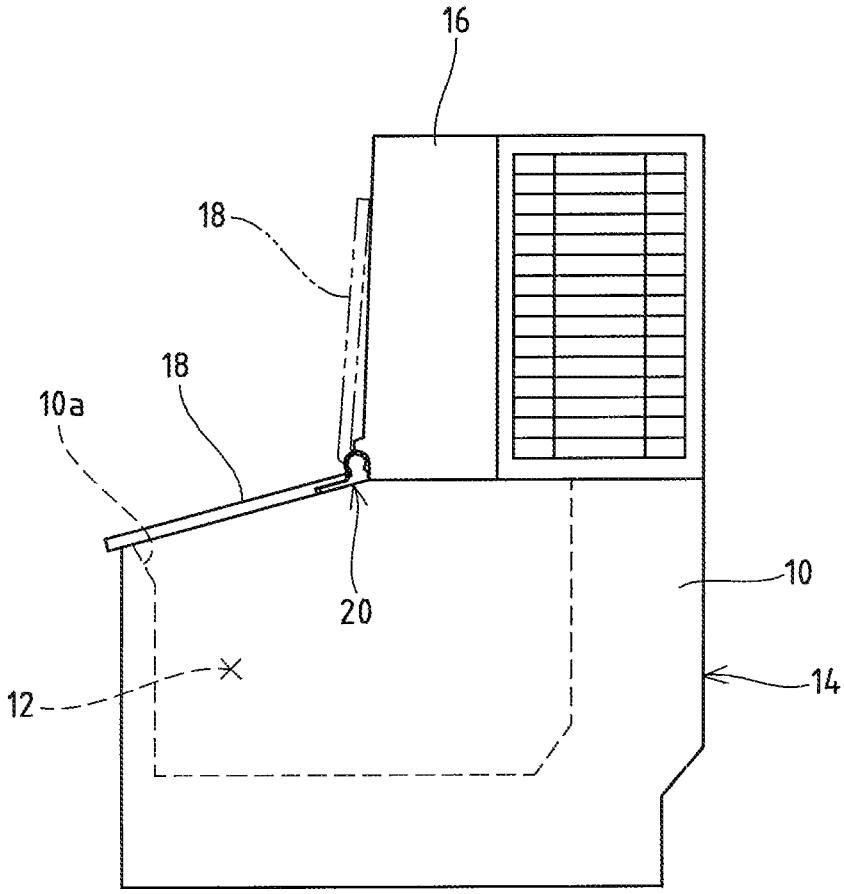
Fig.8 [Prior Art]
FIG. 8 is a side view showing a general automatic icemaker.

A door body holding structure according to the present invention will, now be described hereinafter based on preferred embodiments with reference to the accompanying drawings. In the embodiments, a door body arranged on, an ice storage house in an automatic icemaker will be described. Moreover, since a configuration of the automatic icemaker is the same as that described above in conjunction, with FIG. 8, like reference numerals denote like members, thereby omitting a detailed description thereof. In the following description, when the automatic icemaker in FIG. 8 is seen from a side surface thereof, a side where an ice discharge opening is formed will be referred to as "front", a side where a cabinet is arranged will be referred to as "back", and a direction crossing this front-and-back direction will be referred to as a "left-and-right direction".

Embodiment 1

Figure 1:
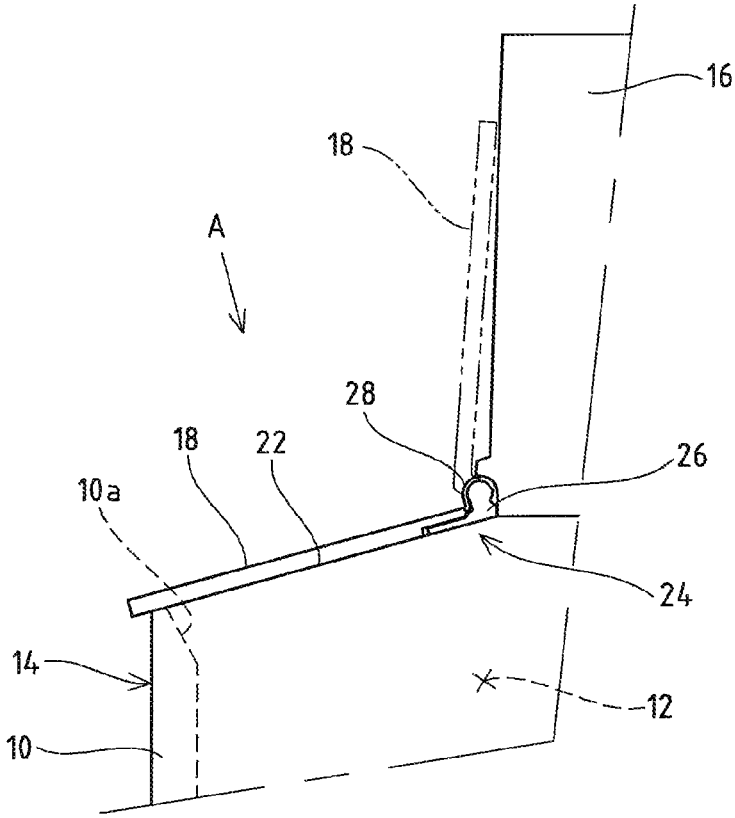
FIG. 1 is a side view showing a primary part of an automatic icemaker adopting a door body, holding structure according to Embodiment 1.
Figure 2:
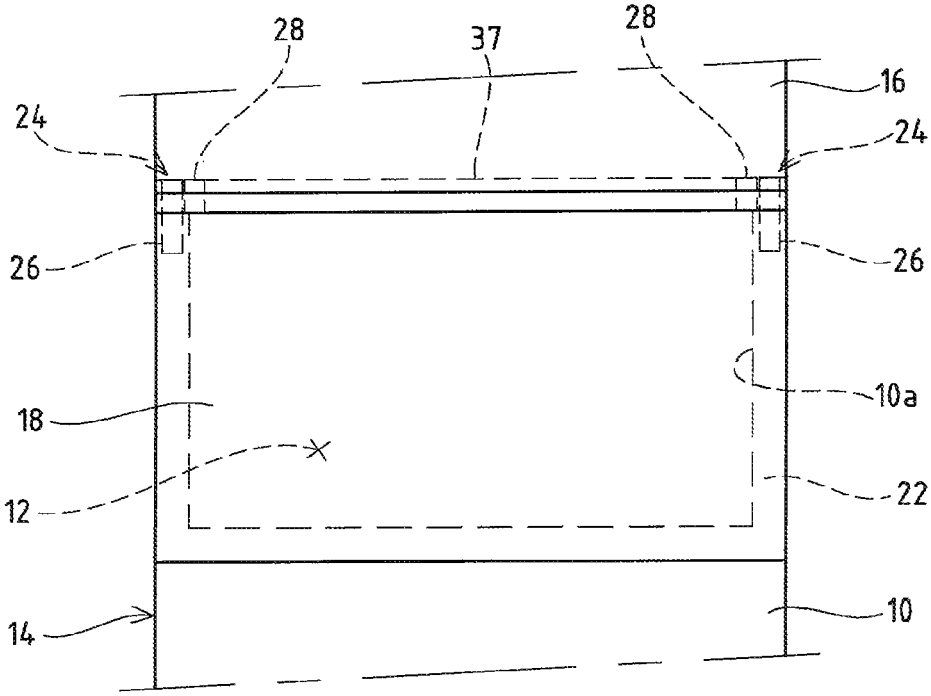
FIG. 2 is a schematic view showing a region where a door body is arranged in the automatic icemaker according to Embodiment 1 from a view A direction in FIG. 1.

As shown in FIG. 1, an upper surface of an ice storage house 14 facing the front side at a position of a housing 10 where a cabinet 16 is arranged is formed so as be downwardly inclined as getting closer to the front side, and an ice discharge opening (an opening portion) 10*a* communicating with an ice storage room 12 is formed in this inclined surface portion 22 so as to be opened in an upwardly oblique direction toward the front side. Additionally, as shown in FIG. 2, a door body 18 having a heat-insulated structure that opens and closes the ice discharge opening 10*a* is arranged on the inclined surface portion 22 of the housing 10 in such a manner that the door body 18 can be pivoted in an up-and-down direction through a pair of hinge devices 24, 24 on left and right sides separated from each other. As indicated by a solid line in FIG. 1, this door body 18 is configured to be pivoted between a closed position at which the ice discharge opening 10*a* is closed with a lower surface of the door body 18 being appressed against the inclined surface portion 22 and an open position at which an end portion (which will be referred to as a front end hereinafter) of the door body 18, which is separated from pivot portions of the hinge devices 24, 24 when the door body 18 is upwardly pivoted from the closed position, opens the ice discharge opening 10*a* facing the upper side. It is to be noted that, at the open position, a gravity center of the door body 18 is close to the cabinet 16 side apart from the pivot portions of the hinge devices 24, 24, and the door body 18 is rested against the front surface of the cabinet 16 in such a manner that the front end comes into contact with this front surface.

Figure 4:
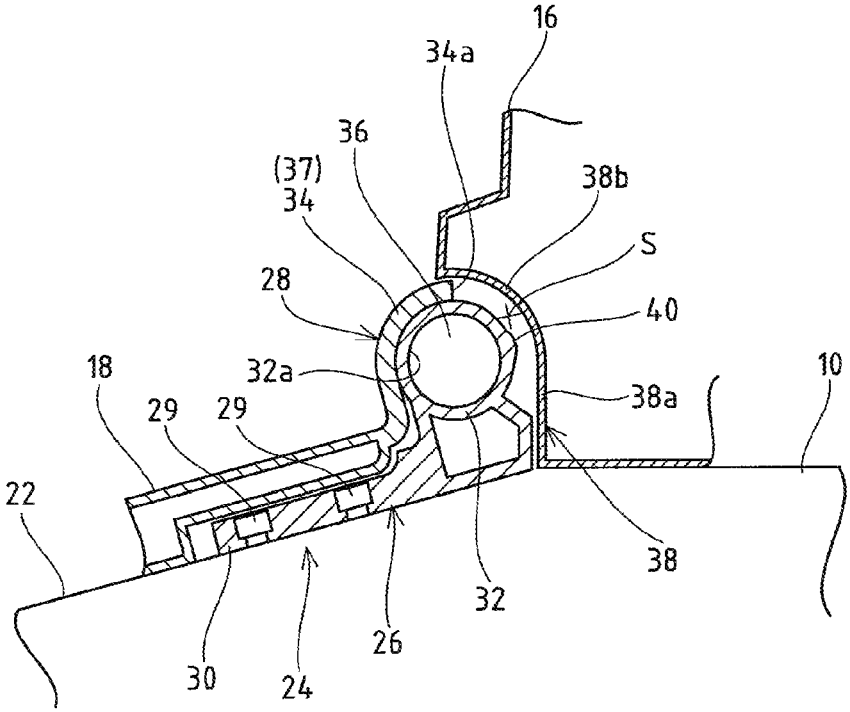
FIG. 4 is a primary part cross-sectional view showing a pivot portion between a door body and a housing according to Embodiment 1 in a state that the door body is at a closed position.
Figure 5:
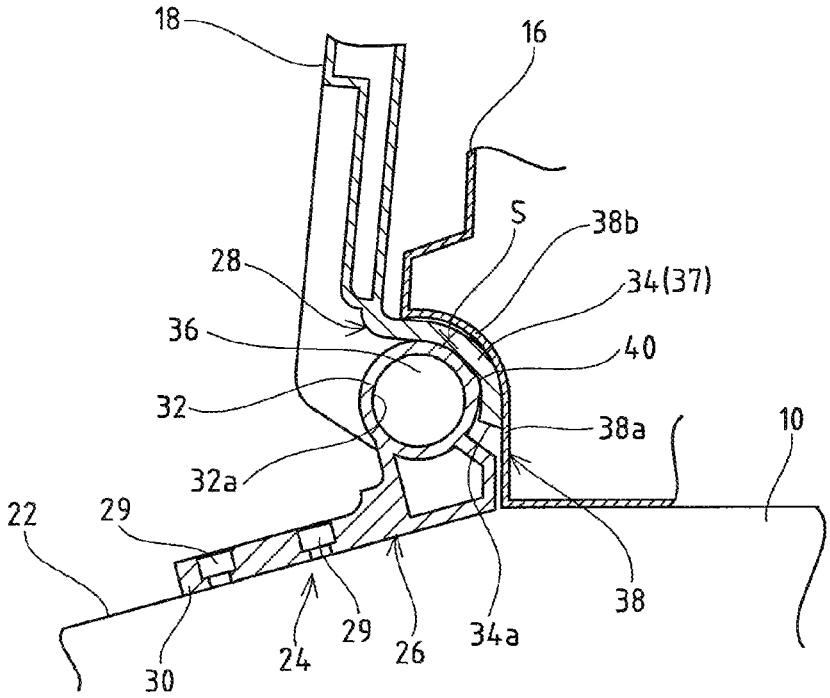
FIG. 5 is a primary part cross-sectional view showing the pivot portion between the door body and the housing according to Embodiment 1 in a state that the door body is at an open position.

Each hinge device 24 includes a fixed-side hinge 26 arranged on the inclined upper side of the inclined surface portion 22 of the housing 10 and a movable-side hinge 28 arranged on a side end at the upper end portion of the door body 18. As shown in FIG. 4 and FIG. 5, the fixed-side hinge 26 is constituted of a main body portion 30 fixed to the housing 10 through screws 29 and a bearing portion 32 that is protruded on an upper surface on a rear end side (a side close to the cabinet 16) of the main body portion 30 and has a bearing hole 32*a* extending in the left-and-right direction. The bearing portion 32 is formed into a cylindrical shape whose outer end sides in the left-and-right direction are closed, and the bearing hole 32*a* is opened to an inner end side. That is, the bearing hole 32*a* in the fixed-side hinge 26 arranged on the right-hand side of the housing 10 is opened on the left-hand side (the fixed-side hinge 26 side on the left), and the bearing hole 32*a* in the fixed-side hinge 26 arranged on the left-hand side is opened on the right-hand side (the fixed-side hinge 26 side on the right).

Each movable-side hinge 28, includes a guide portion (a sandwiched portion) 34 that fits on the bearing portion 32 of the corresponding fixed-side hinge 26 to allow its pivoting motion and a shaft portion 36 fitted and inserted into the beating hole 32*a* of the fixed-side hinge 26 from the inner side to allow its pivoting motion. That is, the shaft portions 36, 36 of both the movable-side hinges 28, 28 are fitted and inserted into the bearing holes 32*a*, 32*a* of the corresponding fixed-side hinges 26, 26, and the door body 18 is arranged on the housing 10 to allow its pivoting motion with the guide portions 34, 34 being fitted on the bearing portions 32, 32. The guide portion 34 is formed into an arc-like shape to be concentric with the shaft portion 36, the guide portion 34 is fitted on the bearing portion 32 from the front side to the upper side when the door body 18 is at the closed position shown in FIG. 4, and its open end portion 34*a* is set be provided at a position substantially immediately above the central position of the bearing portion 32. Further, the guide portion 34 is configured in such a manner that the open end portion 34*a* moves to the back side (the cabinet 16 side) along the outer side of the bearing portion 32 when the door body 18 is pivoted toward the open position (in a clockwise direction in FIG. 4) (see FIG. 5).

As shown in FIG. 4, a containing wall (a holding portion) 38 that partially covers, the bearing portion 32 in the fixed-side hinge 26 from the back, side is provided at a front surface lower end portion of the cabinet 16. This containing wall 38 is formed of a vertical portion 38*a* extending from the upper surface of the housing 10 toward, the substantially vertically upper side and an arc-shaped portion 38*b* extending from an upper end of the vertical portion 38*a* toward the front side in an arc-like shape recessed on a lower side, and the containing wall 38 has necessary elasticity. Furthermore, an arc-shaped containing space S that is opened on the upper side of the bearing portion 32 toward the front side is defined between the containing wall 38 and the bearing portion 32 of the fixed-side hinge 26, and the containing space S is configured to contain the guide portion 34 of the movable-side hinge 28 when the door body 18 is pivoted from the closed position toward the open position. The arc-shaped portion 38*b* of the containing wall 38 is formed into an arc-like shape to be concentric with the bearing portion 32, and the containing space S defined between the arc-shaped portion 38*b* and the bearing portion 32 is also formed into an arc-like shape to be concentric with the bearing portion 32. It is to be noted that, in Embodiment 1, the open end portion 34*a* of the guide portion 14 is placed in the containing space S apart from a front end of the arc-shaped portion 38*b* of the containing wall 38 when the door body 18 is at the closed position as shown in FIG. 4, whereby the open end portion 34*a* of the guide portion 34 is prevented from coming into contact with the front end of the arc-shaped portion 38 to avoid inhibition of the pivoting movement when the door body 18 is pivoted, from the closed position toward the open position.

A flange portion 37 is formed at an upper end portion of the door body 18 over the entire length in the left-and-right direction (see FIG. 2), and left and right end portions of the flange portion 37 are configured to also function as the guide portions 34, 34 of both the movable-side hinges 28, 28. Moreover, the containing wall 38 of cabinet 16 is formed over the entire length of the cabinet 16 in the left-and-right direction, and the open end (the open end portion 34*a*) of the flange portion 37 of the door body 18 is placed in the containing space S over the entire length to be apart from the front end of the arc-shaped portion 38*b* of the containing wall 38 when the door body 18 is at the closed position. That is, these members are configured in such a manner that dew condensation water, which is generated and flows down on the front surface of the cabinet 16, can flow down on the surface of the door body 18 through the flange portion 37 of the door body 18, thereby preventing the dew condensation water from entering the ice storage room 12 from a gap between the door body 18 and the containing wall 38.

Figure 3:
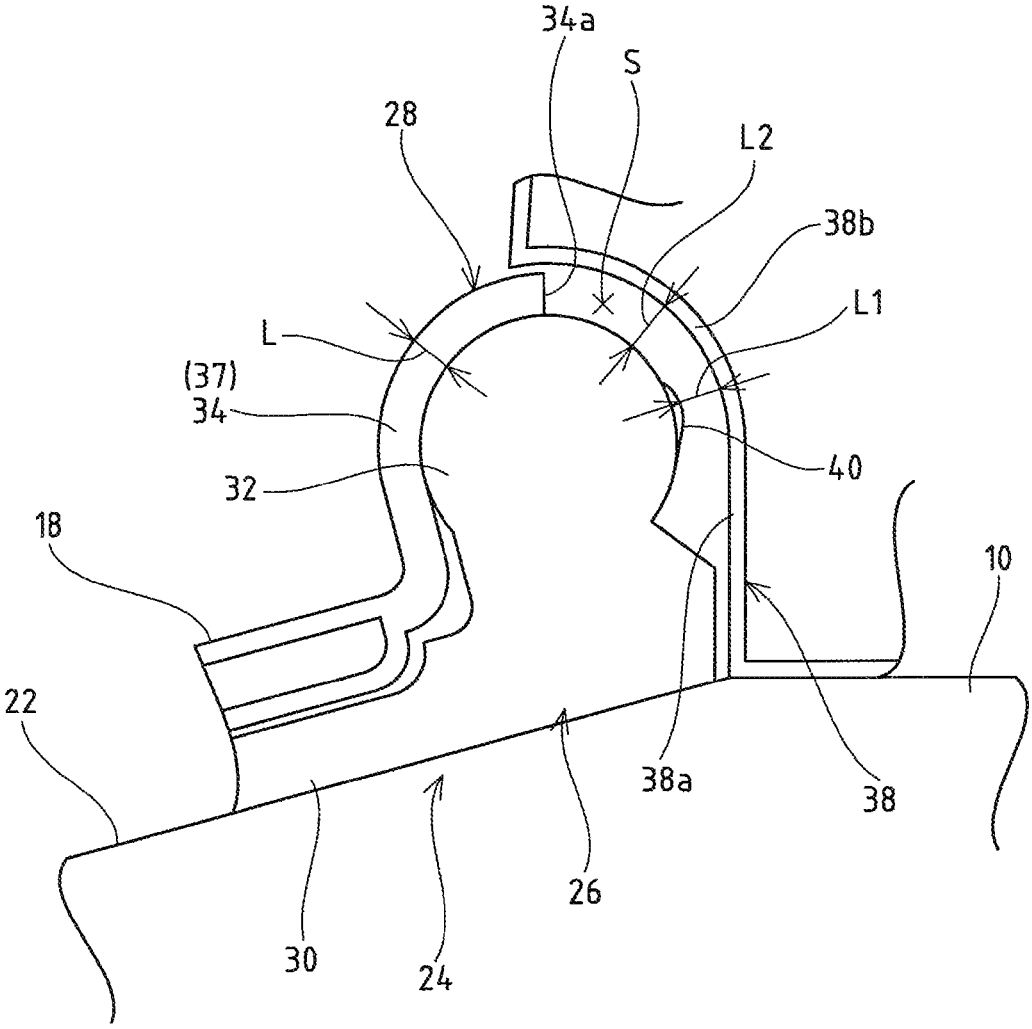
FIG. 3 is an explanatory view showing a relationship between a thickness of a guide, portion and a separation dimension between a projecting portion and a containing wall in the door body holding structure according to Embodiment 1.

As shown in FIG. 3, a projecting portion (a sandwiching portion) 40, which projects toward the containing wall 38 side, is provided on an outer surface of the bearing portion 32 of the fixed-side hinge 26 at a position where this projecting portion 40 faces the containing wall 38 and where the projecting portion 40 does not come into contact with an inner surface (a surface facing the outer surface of the bearing portion 32) of the guide portion 34 when the door body 18, is at the closed position but the same comes into contact with the inner surface of the guide portion 34 when the door body 18 is at the open position. A separation dimension L1 between a projecting end of this projecting portion 40 and the containing wall 38 is set to be smaller than a thickness direction L of the guide portion 34. On the other hand, a separation dimension L2 between the outer surface of the bearing portion 32 excluding a region where the projecting portion 40 is provided and the containing wall 38 is set to be larger than the thickness dimension L of the guide portion 34 ($L1<L<L2$). That is, when the inner surface of the guide portion 34 have moved to the position at which it comes into contact with the projecting portion 40 by the pivoting movement of the door body 18 from the closed position to the open position, the guide portion 34 is sandwiched and held between the projecting portion 40 and the containing wall 38, thereby holding the door body 18 at the open position as shown in FIG. 5.

A rear side of the projecting portion 40 in a moving direction of the guide portion 34 when pivoting the door body 18 from the closed position toward the open position, i.e., a side with which the open end portion 34*a* of the guide portion 34 comes into contact first is inclined to smoothly protrude from the outer surface of the bearing portion 32. As a result, the open end portion 34*a* of the guide portion 34 that moves while being guided by the outer surface of the bearing portion 32 is configured to smoothly move onto the projecting portion 40 while being guided by the inclined surface.

[Operation of Embodiment 1]

An operation of the door body holding structure according, to Embodiment 1 will now be described:

As shown in FIG. 1 and FIG. 4, in a state that the door body 18 is set at the closed position, when pivoting the door body 18 toward the open position, an operator holds the front end of the door body 18 to pivot the door body 18 toward the upper side, whereby the guide portion 34 of each movable-side hinge 28 is gradually contained in the containing space S between the corresponding fixed-side hinge 26 and the containing wall 38. Since the open end portion 34*a* of the guide portion 34 is placed on the containing space S side to be apart from the front, end of the arc-shaped portion 38*b* of the containing wall 38 when the door body 18 is placed at the closed position, the pivoting, movement is not blocked, by contact of the guide portion 34 with the containing wall 38 on the initial stage that the door body 18 is pivoted from the closed position toward the open position thus achieving the smooth pivoting movement of the door body 18. Additionally, since the separation dimension L2 between the outer surface of the bearing portion 32 of the fixed-side hinge 26 excluding the region where the projecting portion 40 is provided and the containing wall 38 is set to be larger than the thickness dimension L of the guide portion 34, the guide portion 34 freely moves in the containing space S, and the door-body 18 smoothly pivots.

When the open end portion 34*a* of the guide portion 34 gets across the position at which the projecting portion 40 of the fixed-side hinge 26 is formed in association with the pivoting movement of the door body 18, the projecting portion 40 comes into contact with the inner surface of the guide portion 34. As described above, since the separation dimension L1 between the projecting portion 40 and the containing wall 38 is set to be smaller than the thickness, dimension L of the guide portion 34, the guide portion 34 is sandwiched and held between the projecting portion 40 and the containing wall 38 as shown in FIG. 5. Specifically, when the open end portion 34*a* of the guide portion 34 gets over the projecting portion 40, the containing wall 38 is elastically deformed, whereby the guide portion 34 is sandwiched and held by elastic force of the containing wall 38. Moreover, when the door body 18 is pivoted to the open position, a gravity center of the door body 18 moves to the cabinet 16 side from the pivot portions of the hinge devices 24, 24, and hence the door body 18 is rested against the front surface of the cabinet 16. That is, the door body 18 is held at the open position by not only displacement of a position, of its gravity center but also a sandwiched state of each guide portion 34 between the protecting portion 40 and the containing wall 38, whereby the door body 18 is not easily pivoted toward the closed position by vibration and others involved by an operation of the ice making mechanism. Therefore, when taking out ice pieces from the ice storage room the operator can freely use both hands, and an operation of taking out the ice pieces can be facilitated. Additionally, the simple structure that the projecting portion 40 is just formed at a part of the bearing portion 32 of each fixed-side hinge 26 is provided, and hence a cost is not greatly increased.

When returning the door body 18 at the open position to the closed position, the front end of the door body 18 is grasped to pivot the door body 18 toward the lower side. At this time, although a certain degree of resistance is imposed until the open end portion 34*a* of the guide portion 34 moves away from the projecting portion 40 of the bearing portion 32, the door body 18 is smoothly pivoted to reach the closed position after the open end portion 34*a* of the guide portion 34 moves away from the projecting portion 40. That is, at the time opening or closing the door body 18, force is required only when pressing the guide portion 34 into the space between the projecting portion 40 and the containing wall 38 acid when pilling the guide portion 34 from the space between the projecting portion 40 and the containing wall 38, but the door body 18 can be easily and smoothly pivoted in any other case, and a burden of an opening/closing operation is not increased. Further, when pressing the guide portion 34 into the space between the projecting portion 40 and the containing wall 38, since a continuously provided portion between the projecting portion 40 and the bearing portion 32 is smoothly inclined as described above, considerably large press force is not required. Furthermore, in a state that the guide portion 34 has been pulled out from the space between the projecting portion 40 and the containing wall 18, the gravity center of the door body 18 gets closer to the front side (the side apart from the cabinet 16) from the pivot portions of the hinge devices 24, 24, and the door body 18 is pivoted toward the closed position by its own weight, whereby the door body 18 is assuredly placed at the closed position where the lower surface thereof is in contact with the inclined surface portion 22, thereby hermetically closing the ice discharge opening 10*a*. It is to be noted that, at the closed position, the open end of the flange portion 37 of the door body 18 is placed in the containing space S apart from the front end of the arc-shaped portion 38*b* of the containing wall 38 over the entire length, whereby the dew condensation water that flows down on the front surface of the cabinet 16 flows down on the surface of the door body 18 through the flange portion 37, thereby preventing the dew condensation water from entering the ice storage room 12 from the gap between the door body 18 and the containing wall 38.

Embodiment 2

Figure 6:
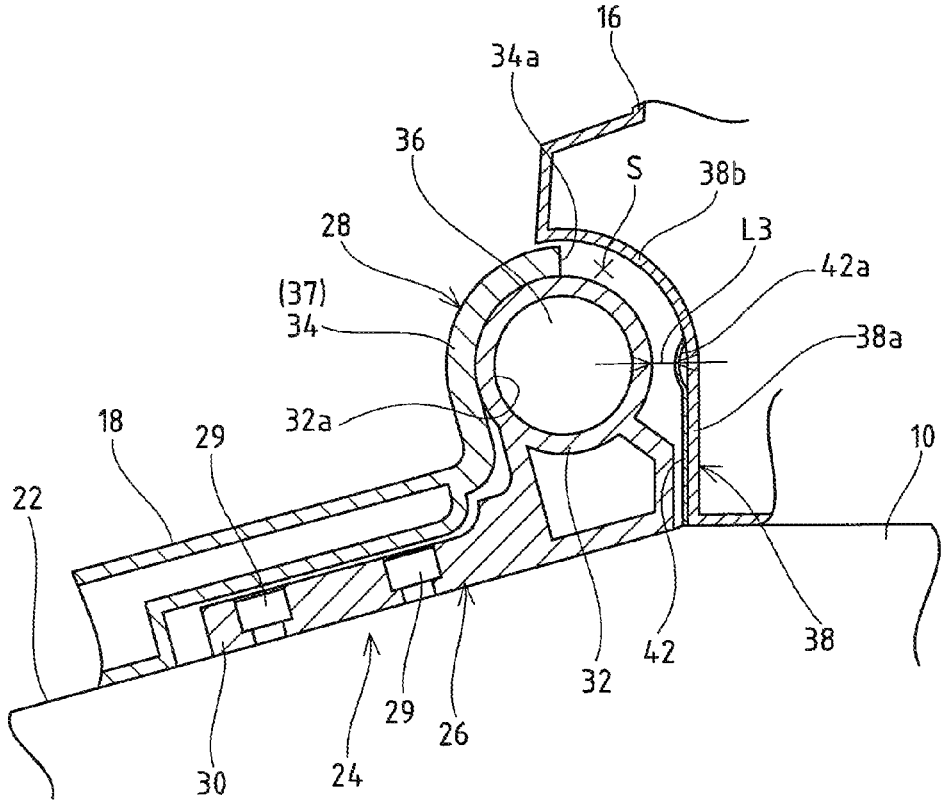
FIG. 6 is primary art cross-sectional view showing a pivot portion between a door body and a housing according to Embodiment 2 in a state that, the door body is at a closed position.
Figure 7:
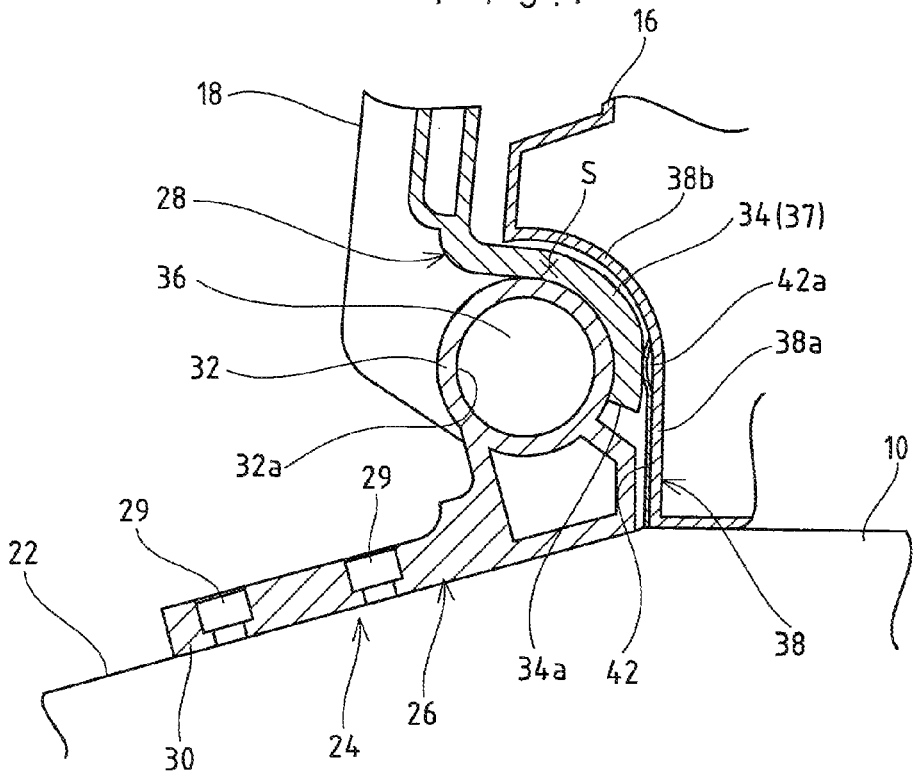
FIG. 7 is a primary part cross-sectional view showing the pivot portion between the door body and the housing according to Embodiment 2 in a state that the door body is at an open position.

FIG. 6 and FIG. 7 show a door body holding structure according to Embodiment 2, and a basic configuration is equal to that in Embodiment 1, thereby giving a description on differences alone. Moreover, like reference, numerals denote the like members.

Although the projecting portion 40 is provided to the bearing portion 32 of the fixed-side hinge 26 in Embodiment 1, a projecting portion is provided on a containing wall side to sandwich and hold a guide portion between the projecting portion and a bearing portion in Embodiment 2. That is, a plate member 42 is additionally provided on an inner surface of the containing wall 38 facing the bearing portion 32 along the vertical portion 38*a*, and a projecting portion 42*a* that bulges in a direction apart from the containing wall 38 (the bearing portion 32 side) is formed at an upper end portion of plate member 42 in a bending manner. A separation dimension L3 between a projecting end of this projecting portion 42*a* and the bearing portion 32 of a fixed-side hinge 26 is set to be smaller than a thickness dimension L of a guide portion 34. Further, as shown in FIG. 6 and FIG. 7, the projecting portion 42*a* of the plate member 42 is set to be placed at a position where the projecting portion 42*a* is not in contact with an outer surface of the guide, portion 34 when a door body 18 is at a closed position but it is in, contact with the outer surface of the guide portion 34 when the door body 18 is at an open position. That is, in Embodiment 2, when the outer surface of the guide portion 34 reaches the position where it comes into contact with the projecting portion 42*a* by pivoting movement of the door body 18 from the closed position to the open position, the guide portion 34 is sandwiched and held between the projecting portion 42*a* and the bearing portion 32, thereby holding the door body 18 at the open position.

As described above, in the thus configured door body holding structure according to Embodiment 2, the same operation and effect as those of Embodiment 1 can be exercised.

[Modification]

The present invention is not restricted to the configurations of the above-described embodiments, and other configurations can be appropriately adopted.

1. Although the projecting portion is provided to the plate member that is a body different from the containing wall in Embodiment 2, it is possible to adopt a configuration that the projecting portion is provided to the containing wall itself and the guide portion of the movable-side hinge is sandwiched and held between the projecting portion and the bearing portion of the fixed-side hinge.
2. Although the number of the projecting portion that comes into contact with the guide portion is one in the description of each embodiment, it is possible to adopt a configuration that a plurality of projecting portions are provided in parallel along a moving direction of the guide portion.
3. Although the containing wall is formed on the cabinet in the description of each embodiment, a containing wall (a holding portion) that is a body different from the cabinet may be arranged on the housing.
4. Although the holding structure is adopted for the door body arranged on the ice storage house in the description of each embodiment, a target on which the door body that can adopt the holding structure is arranged is not restricted to the ice storage house, and the door body can be arranged on a housing, in which an accommodation chamber that accommodates accommodation targets is defined and to which a support portion (corresponding to the cabinet in the embodiments) against which the door body can be rested when the door body is pivoted to the open position can be provided.

The invention claimed is:

1. A door body holding structure having a housing including an ice storage house therein and a cabinet arranged at a rear portion of an upper surface of the ice storage house and that is pivotally supported at an upper end portion of a the housing to be pivotable in a vertical direction and configured to be pivoted between a closed position at which an opening portion formed in the housing is closed and an open position at which the opening portion is opened based on upward pivoting movement from the closed position, the door body holding structure comprising:

a fixed-side hinge that is arranged on the housing;

a movable-side hinge that is arranged at an upper end portion of the door body and pivotally supported on the fixed-side hinge in a pivotable manner;

a sandwiched portion that is provided to the door body and configured to move on an outer side of the fixed-side hinge with the pivoting movement of the door body;

a flange portion that is formed at an upper end portion of the door body over the entire length in a left-and-right direction, and left and right end portions of the flange portion are configured to function as the sandwiched portion;

a holding portion that is provided to the housing at a front surface lower end portion of the cabinet and extending over the entire length of the cabinet in the left-and-right direction to define between the fixed-side hinge and itself a containing space configured to accommodate the sandwiched portion; and a sandwiching portion that is placed in the containing space and reduces a facing gap between the fixed-side hinge and the holding portion in the containing space to be smaller than a thickness dimension of the sandwiched portion, wherein the sandwiching portion is a projecting portion that is provided on an outer surface of the fixed-side hinge and projects toward the holding portion side and is provided at a position where the sandwiched portion is sandwiched and held between the sandwiching portion and the holding portion when the door body is at the open position, and an open end portion of the flange portion is placed in the containing space over the entire length to be apart from a front end of an arc-shaped portion of the holding when the door body is at the closed position.

* * * * *